US009499871B2

(12) United States Patent
Pedersen

(10) Patent No.: US 9,499,871 B2
(45) Date of Patent: Nov. 22, 2016

(54) PELT BOARD WITH EXPANSION MEANS

(71) Applicant: 4M Globe Management Ltd., London (GB)

(72) Inventor: Kurt Pedersen, Vinderup (DK)

(73) Assignee: Eikon Technologies Holding Sarl., Luxembourg (LU)

( * ) Notice: Subject to any disclaimer, the term of this patent is extended or adjusted under 35 U.S.C. 154(b) by 147 days.

(21) Appl. No.: 14/423,964

(22) PCT Filed: Aug. 12, 2013

(86) PCT No.: PCT/EP2013/066800

§ 371 (c)(1),
(2) Date: Feb. 25, 2015

(87) PCT Pub. No.: WO2014/032950

PCT Pub. Date: Mar. 6, 2014

(65) Prior Publication Data

US 2015/0191802 A1 Jul. 9, 2015

(30) Foreign Application Priority Data

Aug. 30, 2012 (DK) ..... 2012 70522
Jan. 28, 2013 (DK) ..... 2013 70048

(51) Int. Cl.
*C14B 15/06* (2006.01)
*C14B 1/26* (2006.01)

(52) U.S. Cl.
CPC *C14B 15/06* (2013.01); *C14B 1/26* (2013.01)

(58) Field of Classification Search
CPC ..... C14B 15/06; C14B 1/26
See application file for complete search history.

(56) References Cited

U.S. PATENT DOCUMENTS 1,232,059 A 7/1917 Long
1,483,822 A 2/1924 Marker (Continued)

FOREIGN PATENT DOCUMENTS

CN 2806482 Y 8/2006
WO WO 82/03634 A1 10/1982

(Continued)

OTHER PUBLICATIONS

International Search Report completed Nov. 7, 2013 for International Application No. PCT/EP2013/066800.
Written Opinion completed Nov. 7, 2013 for International Application No. PCT/EP2013/066800.

*Primary Examiner* — Shaun R Hurley
(74) *Attorney, Agent, or Firm* — Brinks Gilson & Lione

(57) ABSTRACT

A pelt board is disclosed for stretching and drying of tubular pelts, the pelt board having a tip end (13) from which the pelt is drawn onto the pelt board and a foot end (11), the pelt board comprising two broad elongated side surfaces (14, 15), wherein the pelt board comprises expansion means (3, 6) defining a narrow elongated side surface extending between side edges (4, 5, 7, 8) of the two broad elongated side surfaces (14, 15), and activation means (9) for selectively moving the expansion means (3, 6) to an expanded position and locking the expansion means (3, 6) in the expanded position, or unlocking the expansion means (3, 6) so that the expansion means (3, 6) are movable to a non-expanded position in which the outer cross-sectional circumference of the pelt board is reduced as compared to the expanded position.

17 Claims, 11 Drawing Sheets

(56) References Cited

U.S. PATENT DOCUMENTS 1,731,144 A * 10/1929 Lord ..... C14B 1/26 223/65
1,892,137 A * 12/1932 Colf ..... C14B 1/26 69/19.2
1,922,671 A * 8/1933 Falley ..... C14B 1/26 69/19.2
2,231,903 A 2/1941 Graham
2,247,738 A * 7/1941 Welty ..... C14B 1/26 69/19.2
2,362,062 A 11/1944 Fishbeck
2,380,135 A * 7/1945 West ..... C14B 1/26 69/19.2
2,485,242 A 10/1949 Leighton
2,534,071 A * 12/1950 Schulz, Sr. ..... C14B 1/26 69/19.2
3,137,963 A 6/1964 Hein
3,271,981 A 9/1966 Hein
3,313,038 A 4/1967 Bolz
4,381,654 A * 5/1983 Baldridge ..... C14B 15/06 69/19.2
4,848,108 A * 7/1989 Thompson ..... C14B 15/06 69/19.2
4,945,736 A * 8/1990 Lagori ..... C14B 15/06 69/19.2
5,564,293 A * 10/1996 Black ..... C14B 15/06 38/102
D704,797 S * 5/2014 Pedersen ..... D22/199

FOREIGN PATENT DOCUMENTS

WO WO 2005/026394 A1 3/2005
WO WO 2007/071259 A1 6/2007
WO WO 2007/071260 A1 6/2007

* cited by examiner

PELT BOARD WITH EXPANSION MEANS

This application claims the benefit under 35 U.S.C. §371 of International Application No. PCT/EP2013/066800, filed Aug. 12, 2013, which claims the benefit of Danish Patent Application No. PA 2012 70522, filed Aug. 30, 2012, and Danish Patent Application No. PA 2013 70048, filed Jan. 28, 2013 which are incorporated by reference herein in their entirety.

The present invention relates to a pelt board for stretching and drying of tubular pelts from fur animals, in particular from mink.

BACKGROUND

Frames on which pelts can be stretched and dried after pelting of the fur animals are well known in the art, ranging from a simple flat and solid wooden slat to more sophisticated pelt boards (or pelting boards) in wood or plastic material.

U.S. Pat. No. 3,313,038 discloses a pelt drying frame in plastic or non-absorbent material and wood which as an open internal structure that allows for drying air to be supplied to the cavity defined by the frame and the tubular pelt in order to enhance the drying of the pelt. The frame also contains an arrangement for stretching of the tubular pelt in the longitudinal direction thereof.

Another pelting board is disclosed in WO 82/03634, which is manufactured in a non-absorbent plastic and comprises a lattice of girders between the edges of the pelting board for improving the airflow of drying air inside the pelting board.

A problem for the aforementioned types of pelt boards is that the tubular pelt shrinks during the drying process and will exert a squeezing force on the pelt board. Thus, the dried pelt may be difficult to remove from the pelt board and in a few case it is necessary to cut the pelt open to be able to remove it from the pelt board.

An alternative arrangement for drying of tubular pelts is disclosed in U.S. Pat. No. 3,137,963 and in U.S. Pat. No. 3,271,981 comprises a frame with two legs that are pivotally connected at one end, which is inserted into the tubular pelt to be dried, and a lever at the opposite end which is used to force the two legs from each other and ensure that the pelt is taut on the frame when drying. When the pelt is sufficiently dry, the lever is turned and the legs are allowed to pivot and collapse the frame for easy removal of the dried pelt. The pelt is during the drying only supported by the two legs for promoting the circulation of air on the inside of the pelt. However, it is today preferred to dry the pelts on an actual pelt board that support the inner surface of the tubular pelt during the drying process.

In order to facilitate a more efficient removal of the dried pelt from the pelt board, the pelt board disclosed in WO 2005/026394 was provided, comprising two half parts that are forced from each other and locked in a position, where the circumference is larger and slot-shaped openings are formed between the edges of the half parts and where the pelt is drawn upon the pelt board for drying thereof, and the pelt board may when the pelt is dried be shifted to a second position where the edges of the two half parts abut and the circumference consequently is smaller and the pelt may be removed more easily.

It is an object of the present invention to provide an alternative pelt board that facilitates the removal of the dried pelt and has an improved wear-resistance. This and other objects are reached with the present invention as disclosed below.

BRIEF DESCRIPTION OF THE INVENTION

The present invention relates to a pelt board for stretching and drying of tubular pelts, the pelt board having a tip end from which the pelt is drawn onto the pelt board and a foot end, the pelt board comprising two broad elongated side surfaces for supporting the tubular pelt, wherein the pelt board comprises expansion means defining a narrow elongated side surface extending between side edges of the two broad elongated side surfaces, and activation means for selectively moving the expansion means to an expanded position and locking the expansion means in the expanded position, or unlocking the expansion means so that the expansion means are movable to a non-expanded position in which the outer cross-sectional circumference of the pelt board is reduced as compared to the expanded position. Hereby, a substantial part of the forces exerted by the dried pelt on the pelt board, i.e. the squeezing of the pelt board by the dried pelt, is thus supported by the stationary parts of the pelt board, the two broad elongated side surfaces, whereas the movable part (or parts) only supports a minor share of the forces from the narrow elongated side surface(s), for which reason the mechanism for providing the movement of the movable part(s) and thus the reduction in cross-sectional circumference of the pelt board for facilitating the removal of the dried pelt is much less exposed to mechanical failure due to wear or fatigue.

The two broad elongated side surfaces are arranged so that the inner side of the tubular pelt during use of the pelt board is supported on these side surfaces and so that the surface area of the broad elongated side surfaces in contact with the inner side or skin side of the pelt during use constitute at least 50% of the total surface area in contact with the inner side or skin side of the pelt during use, preferably at least 75%, the remaining area being that of the narrow elongated side surface(s). The expansion means is arranged so that the inner side of the tubular pelt during use of the pelt board with the expansion means in its expanded position is in contact with the narrow elongated side surface defined by the expansion means.

The expansion means is moved generally away from and towards a centre line of the pelt board when the expansion means are moved to the expanded position and to the non-expanded position, respectively.

By the terms broad and narrow side surfaces is understood that the pelt board is of a flattened cross-sectional shape, so that the longer dimension of the cross-sectional shape when the expansion means is in an expanded position is at least twice the shorter dimension thereof, such as between 2.5 and 3 times the shorter dimension of the cross-sectional shape over a majority of the longitudinal extend of the pelt board, such as at least 75% of the longitudinal extend of the pelt board. The cross-sectional shape of the pelt board will normally be less flattened near the tip end.

The pelt board is preferably of a symmetrical configuration, i.e. that the board is symmetrical around a first longitudinal plane extending through a centre line of the board and parallel to the broad elongated side surfaces. The pelt board may also be symmetrical around a second longitudinal plane extending through the centre line and being perpendicular to the first plane.

The outer circumference of the pelt board is reduced over a majority of the longitudinal extend of the pelt board, such as at least 75% of the longitudinal extend thereof when the expansion means are in a non-expanded position. The expansion means may cover more than that part of the longitudinal extend of the pelt board but can be pivotable connected to the rest of the pelt board so that only part of the expansion means are moved back and forth when the activation means is operated.

The expansion means may in one embodiment extend along one side of the pelt board only and thus defines one narrow elongated side surface of the pelt board. However, it is preferred that the expansion means defines narrow elongated side surfaces between side edges on both sides of the two broad elongated side surfaces.

The outer cross-sectional circumference of the pelt board is preferably reduced by at least 3 millimeter when the expansion means are in its non-expanded position over a majority of the longitudinal extend of the pelt board, such as at least 75% of the longitudinal extent thereof. It is further preferred that the outer cross-sectional circumference of the pelt board is reduced in the range of 3 to 20 millimeters when the expansion means are in the non-expanded position of the expansion means, preferably in the range of 5 to 15 millimeters as compared to the circumference of the pelt board when the expansion means are in the non-expanded position.

The broad elongated side surfaces extend substantially in parallel. Although these side surfaces in a preferred embodiment each are formed with a conical shape, such shape as e.g. shown in the accompanying drawing is still considered to constitute substantially parallel extending side surfaces.

The activation means may comprise an element projecting from one of the ends of the pelt board, wherein the activating element may be operated by means of the projecting element. By the term operated is understood that the activation means is brought to either moving the expansion means to the expanded position and locking the expansion means in that position or to unlock the expansion means. In particular, the projecting element may project from the foot end of the pelt board.

In a particular embodiment, the pelt board comprises two projecting elements, one projecting from each end of the pelt board.

The activation means may in particular be operated by pulling and/or pushing the projecting element(s) in the longitudinal direction of the pelt board.

The pelt board may be provided with at least one inlet for receiving a flow of drying air and wherein the two broad elongated side surfaces comprises openings connected to said inlet for providing a flow of air to a pelt arranged on the pelt board.

At least one of said inlets for receiving a flow of air is preferably situated in the projecting element.

The two broad elongated side surfaces may preferably each comprise a plurality of longitudinally extending ridges so that drying air may be distributed and flow alongside the skin side of the pelt arranged on the pelt board. In a specific embodiment, at least some of the ridges are provided with teeth and/or indentations at least at a lower part of the pelt board. The teeth and/or indentations provide for a better grip of the inner side of the tubular pelt on the surface of the pelt board when the pelt has been stretched and is fastened to the pelt board by wrapping an elastic tape around the lower part of the pelt or by drawing a somewhat elastic, open-ended bag onto the pelt board on the outside of the pelt.

The activation means comprises in a preferred embodiment of the present invention an elongated activation member extending in the longitudinal direction of the pelt board and being arranged for being displaceable in the longitudinal direction of the pelt board, a side edge of the activation means being in engagement with a corresponding side edge of the expansion means and comprising a series of wedge-shaped protrusions with an edge slanted with respect to the longitudinal direction alternately with straight edge sections.

The wedge-shaped protrusions are provided for transferring a longitudinal movement of the activation means to an outwards transversal displacement of the expansion means towards the expanded position of the pelt board and the corresponding straight-edge sections of the corresponding side edges of the activation means and the expansion means will ensure that the expansion means are locked in that position until the activation means is moved longitudinally in the opposite direction so as to unlock the expansion means.

The pelt board according to the invention may be provided with a plurality of marks distributed in the longitudinal direction of the pelt board to provide for visual detection of the length of the pelt stretched on and fastened to the pelt board. The length may be detected by the person handling the pelt board to automatically by a machine doing the same, e.g. for a pre-sorting to the pelts prior to drying the pelts on the pelt board or prior to the removal of the pelts from the pelt boards.

BRIEF DESCRIPTION OF THE DRAWING

Embodiments of the present invention are shown in the enclosed drawing of which

DETAILED DESCRIPTION OF EMBODIMENTS OF THE PRESENT INVENTION

Figure 1:
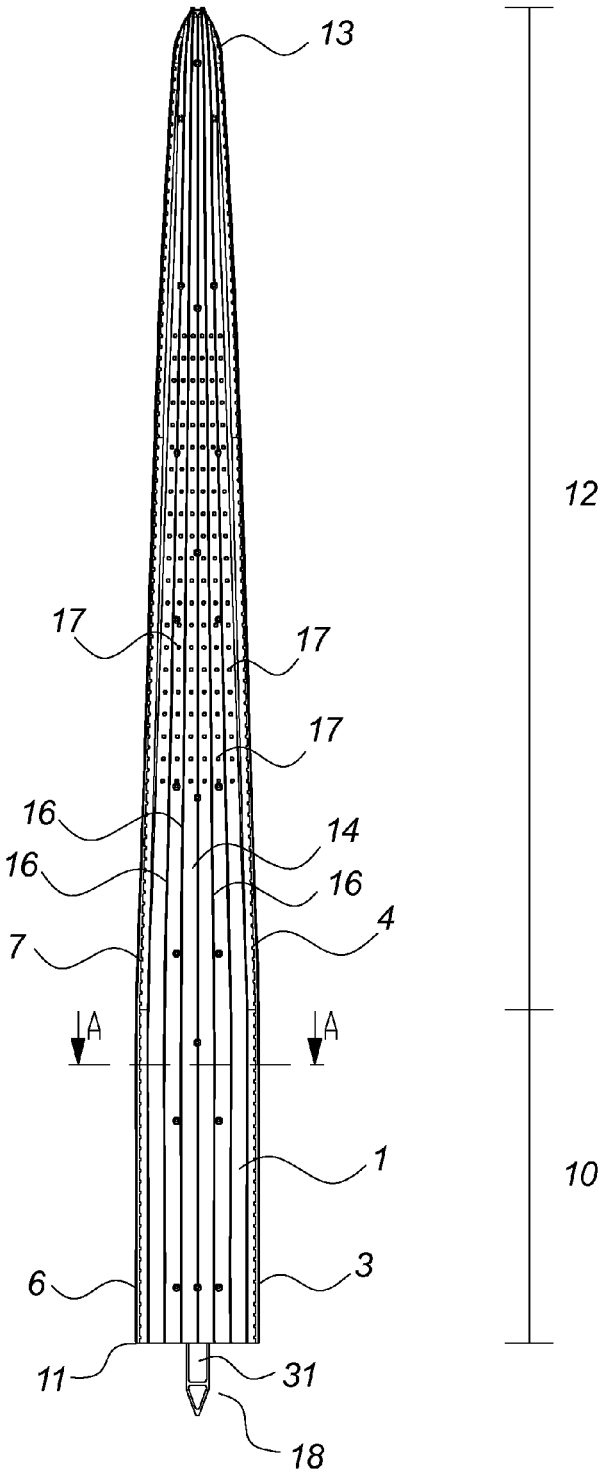
FIG. 1 is a front view of a first embodiment of a pelt board according to the present invention, where the expansion means are in an expanded position.
Figure 2:
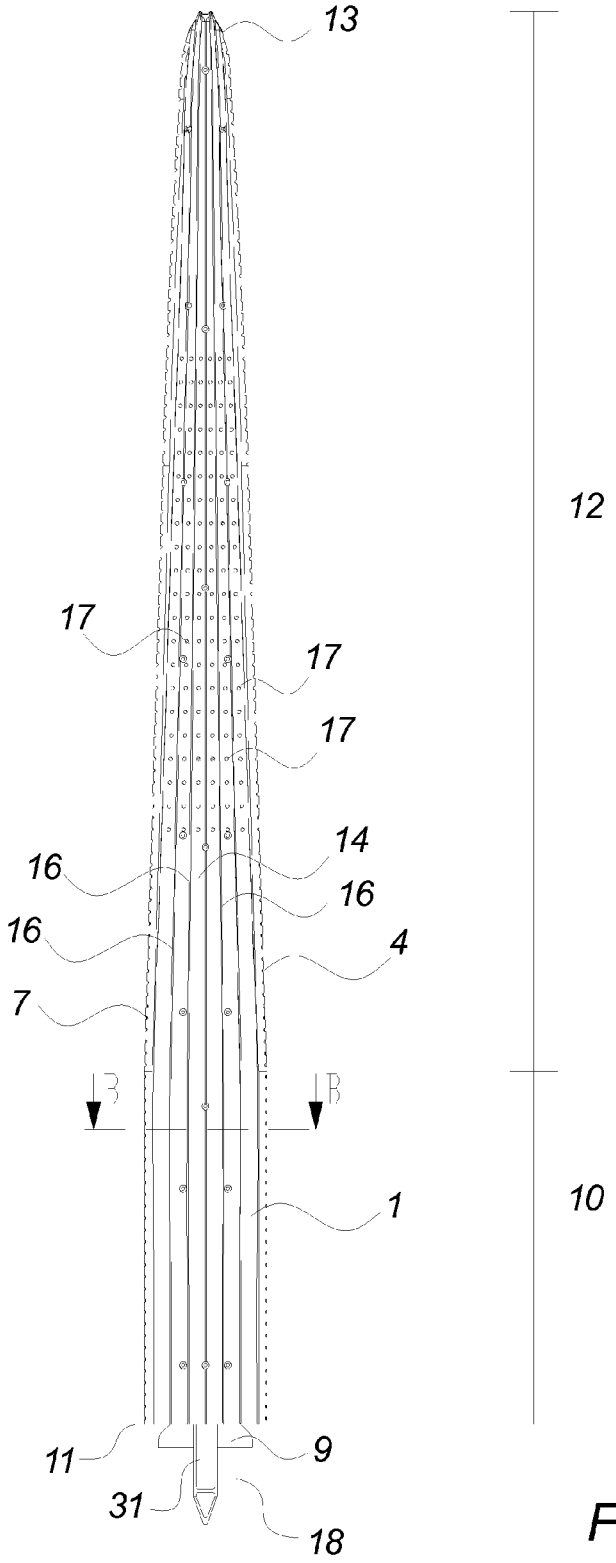
FIG. 2 is a front view of the pelt board of FIG. 1, where the expansion means are in a non-expanded position.
Figure 3A:
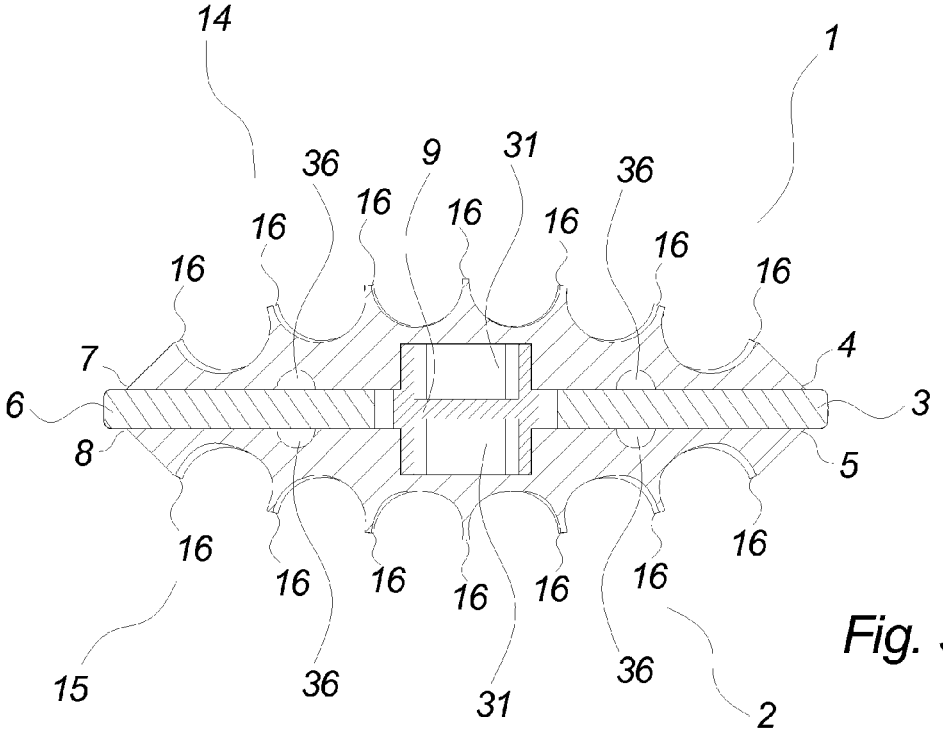
FIG. 3*a* is a cross-sectional view along A-A of the pelt board of FIG. 1, where the expansion means are in an expanded position.
Figure 3B:
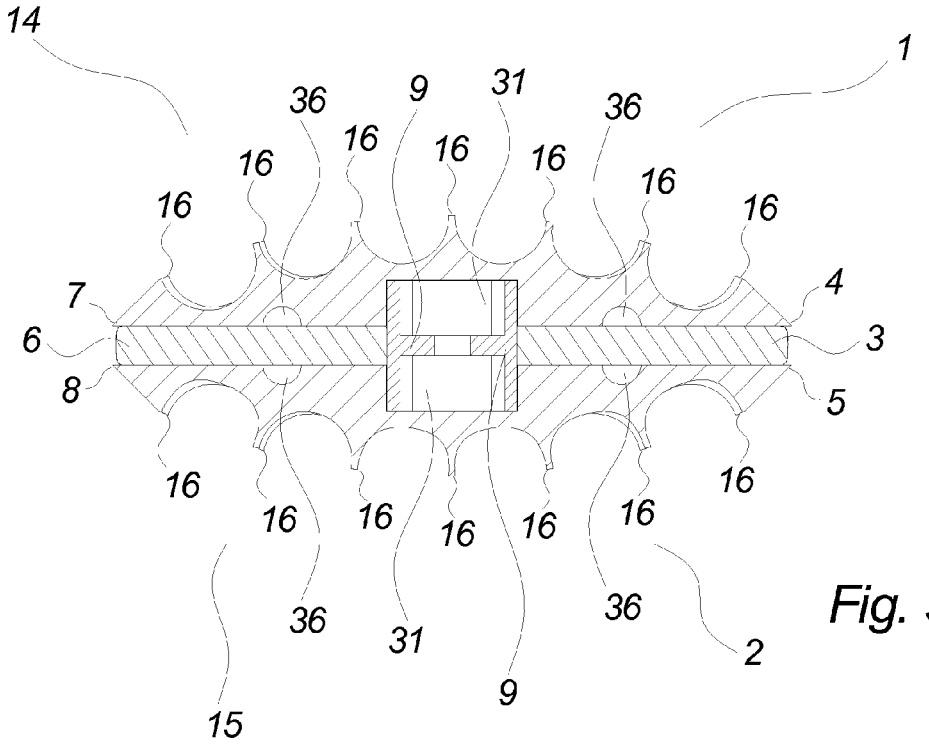
FIG. 3*b* is a cross-sectional view along B-B of the pelt board of FIG. 2, where the expansion means are in a non-expanded position.
Figure 4A:
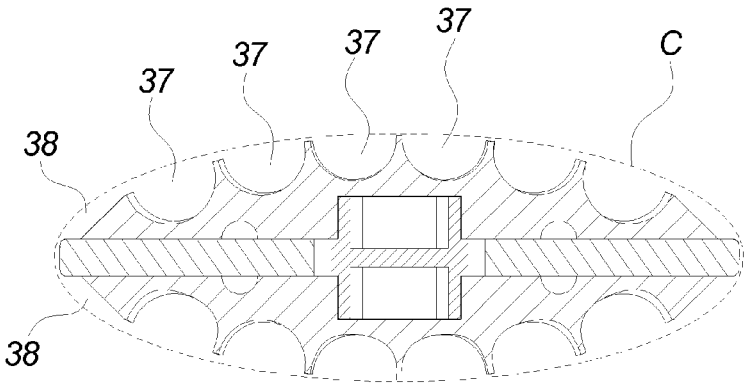
FIG. 4*a* is the view of FIG. 3*a* where the outer cross-sectional circumference of the pelt board is indicated.
Figure 4B:
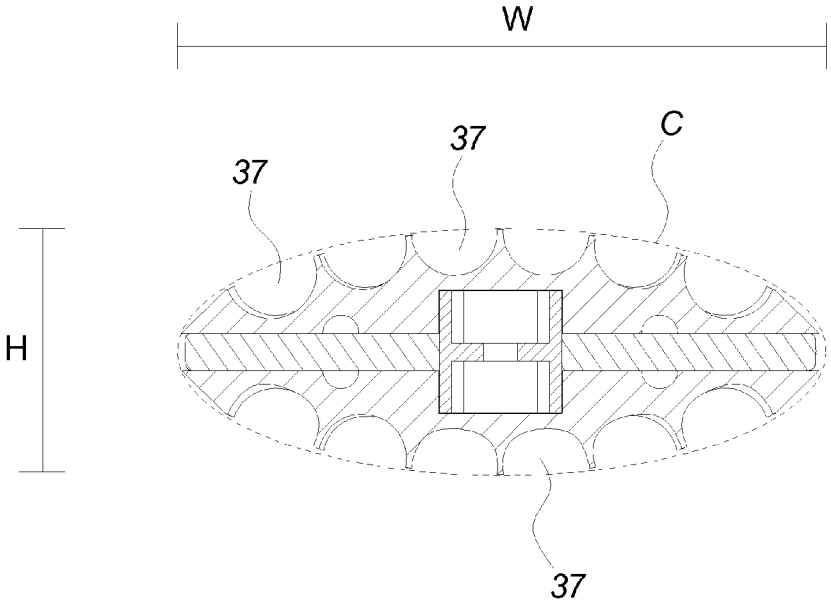
FIG. 4*b* is the view of FIG. 3*b* where the outer cross-sectional circumference of the pelt board is indicated.
Figure 6:
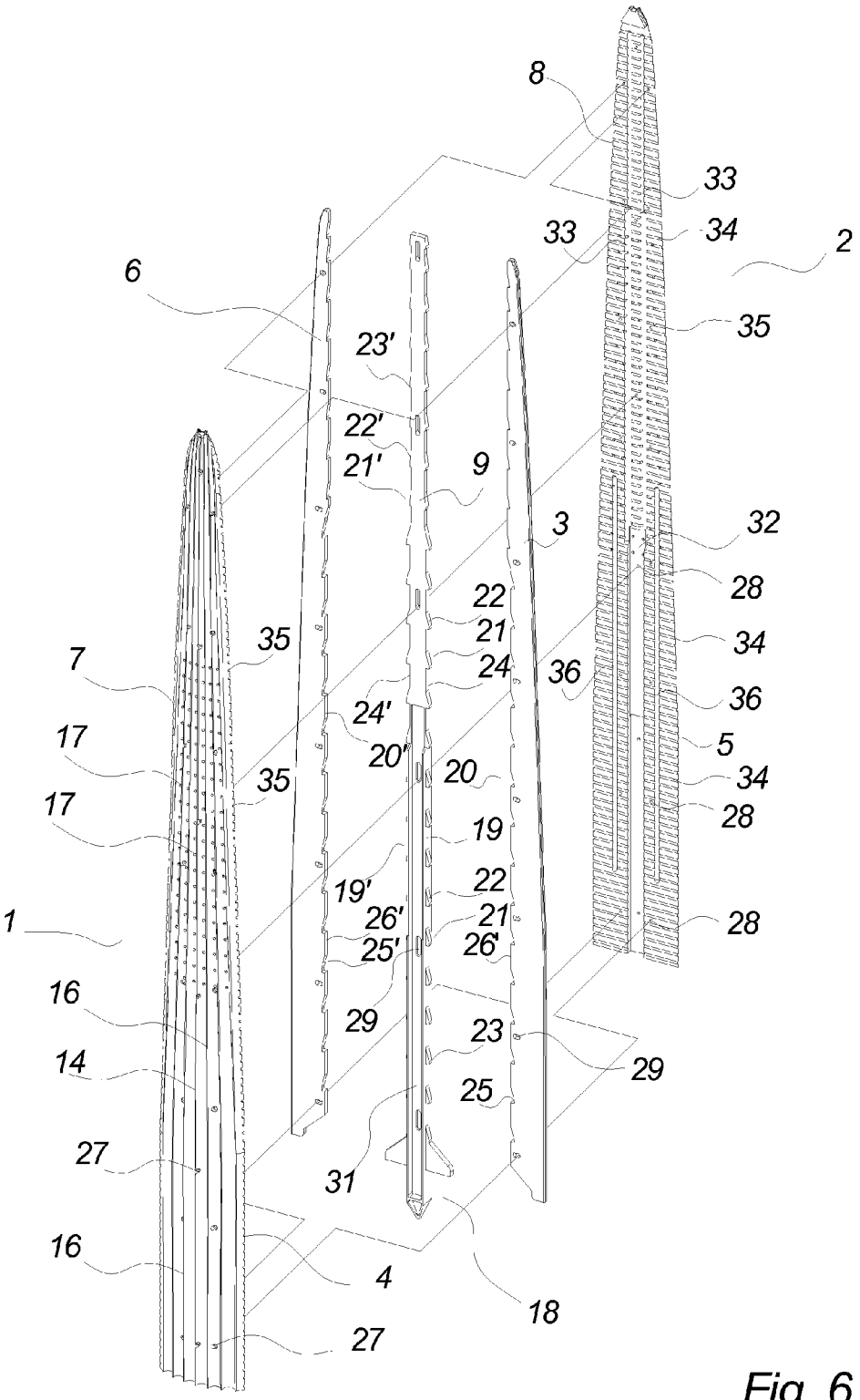
FIG. 6 is an is an exploded view of the pelt board of FIG. 1.
Figure 7:
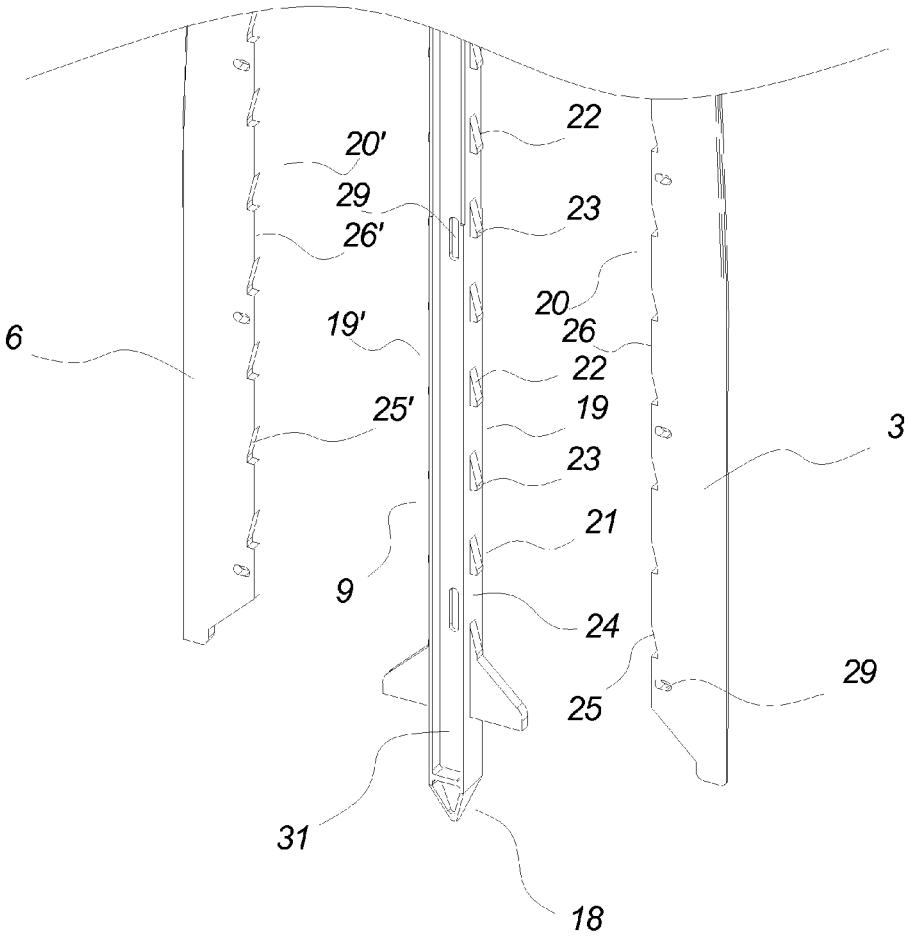
FIG. 7 is a detail of the lower part of the exploded view of FIG. 6.
Figure 8:
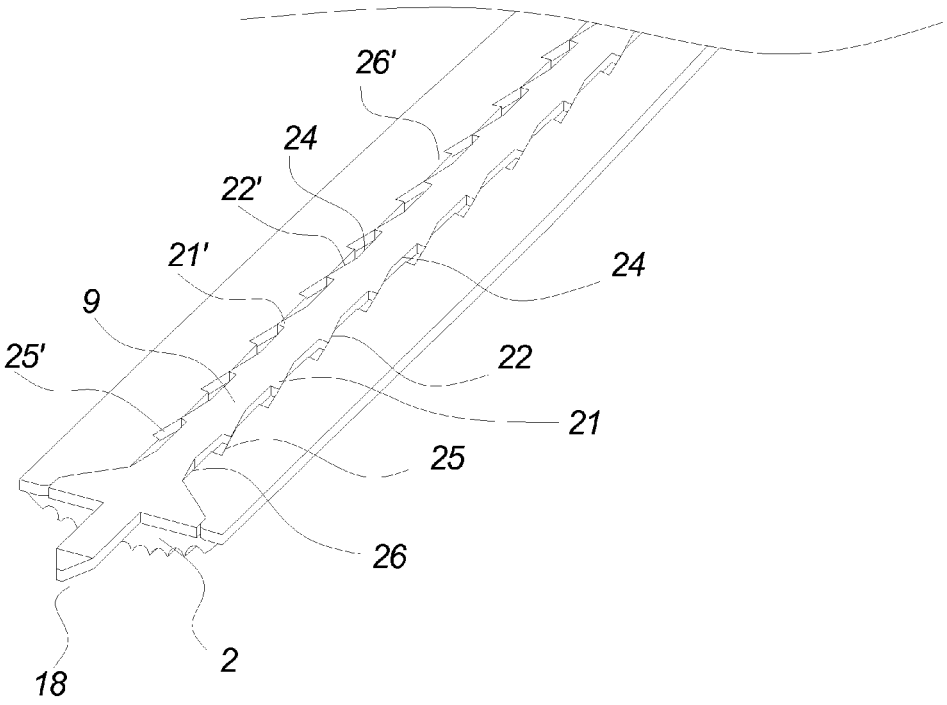
FIG. 8 is a detail in perspective view of the pelt board of FIG. 1 in the expanded position, where the front half part is removed.

The pelt board according to the embodiment shown in FIGS. 1 to 8 comprises a front half part 1 and a similar back half part 2, an expansion strip 3 between the left edges 4, 5 of the half parts 1, 2 and a corresponding expansion strip 6 between the right edges 7, 8 of the half parts 1, 2. An activation rod 9 is arranged between the half parts 1, 2 and between the expansion strips 3, 6 to drive the expansion strips 3, 6 to an expanded position as shown in FIGS. 1, 4 and 8 and lock the expansion strips 3, 6 in that position.

The pelt board parts are manufactured preferably by injection moulding preferably in a non-absorbing material, in particular a hard plastics material such as polycarbonate, polyethylene or polypropylene. Alternatively, a moisture-absorbing material such as polyoxymethylene (POM) may be applied at least for some parts, such as the front and back half parts 1, 2.

Figure 5A:
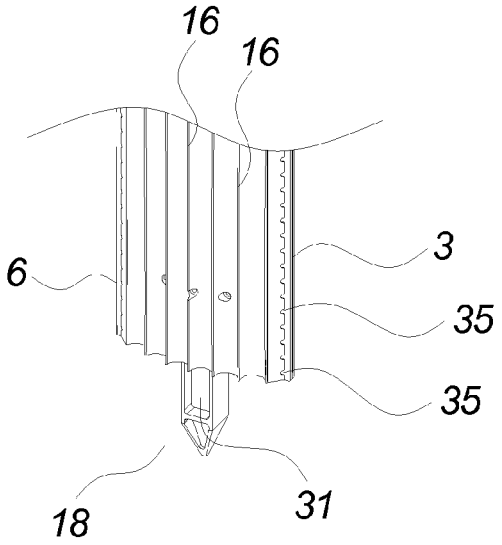
FIG. 5*a* is a perspective view of the lower part of the pelt board according to FIG. 1 in the expanded position.
Figure 5B:
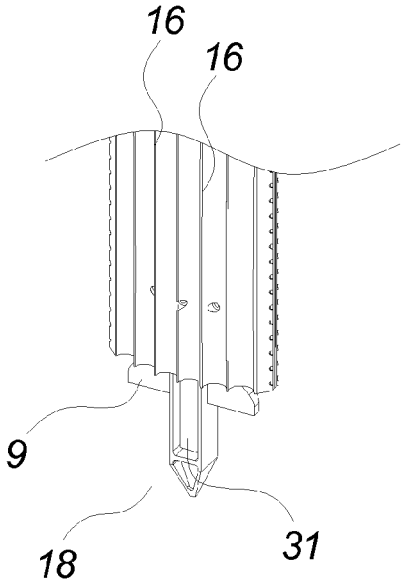
FIG. 5*b* is a perspective view of the lower part of the pelt board according to FIG. 1 in the non-expanded position.

The pelt board comprises a straight section 10 extending from the foot end 11 of the pelt board and about a quarter of the full extent of the pelt board, followed by a conical section 12 extending to the tip end 13 of the pelt board. The straight section 10 constitutes about one quarter of the full length of the pelt board, whereas the conical section 12 constitutes the remaining three quarter of full length of the pelt board, which for the standard pelt board shown is 1200 millimeters from tip end 13 to foot end 11. The cross-sectional shape of the pelt board is generally that of a flattened, curved shape as seen in FIGS. 4 and 5, and formed so that the longer dimension (width W) of the cross-sectional shape when the expansion means is in an expanded position is at least twice the shorter dimension thereof (height H), such as between 2.5 and 3 times the shorter dimension H of the cross-sectional shape over a majority of the longitudinal extend of the pelt board, such as at least 75% of the longitudinal extend of the pelt board. The curve along which the cross-sectional circumference is measured is shown in FIGS. 4 and 5 as the broken line C, which is the circumscribed curve around the cross-section of the pelt board and corresponds to the length of the pelt around the cross-section when the pelt is arranged on the pelt board for drying. The cross-sectional circumference at the straight section 10 is 250 millimeters in the expanded position of the expansion strips 3, 6 and about 240 millimeters in the non-expanded position, thus the outer cross-sectional circumference of the pelt board is reduced by about 10 millimeter when the expansion means 3, 6 are in its non-expanded position at the straight section 10, where each expansion strip 3, 6 is moved about 4 millimeters. At the conical section, the corresponding reduction of the outer cross-sectional circumference is less but the reduction will over at least 75% of the longitudinal extent of the pelt board be more than 5 millimeters. At the tip end 13 of the pelt board, the expansion strips 3, 6 are each moved about 2 millimeters at their tip end position which is 20 millimeters from the end point of the tip end 13.

Both of the half parts 1, 2 are on the outer broad elongated side surfaces 14, 15 equipped with a plurality of longitudinally extending ridges 16 and a plurality of openings 17 for providing a flow of air to a the inner side, i.e. the skin side of a pelt arranged on the pelt board so that the drying of the pelt is facilitated by the flow of air. The openings 17 are connected to an inlet for receiving a flow of air, the inlet being situated in an element 18 projecting from the foot end 11 of the pelt board by means of which the pelt board may be supported in a drying arrangement which is well-known, so that the elements projects into a cavity of the drying arrangement from which an air flow is provided through the projecting element 18 and out through the openings 17.

The activation rod 9 is from the projecting element 18 equipped with open channels 31 on opposing sides for guiding an air flow from a drying arrangement to a mid-point 32 inside the pelt board as shown in the exploded view of FIG. 6 from which the air is distributed upwards towards the tip end 13 in an upper set of longitudinal channels 33 connected to a plurality of transversal channels 34 guiding the air to the openings 17 in the half parts 1, 2 as well as to outlets 35 at the outer end of the transversal channels 34 at the edges of the pelt board. A lower set of longitudinal channels 36 also receive air from the midpoint for a similar distribution in the lower part of the pelt board. The air that exits from the openings 17 will flow through the longitudinal spaces 37 at the surface of the two half parts 1, 2 formed by the ridges 16 and an inner bag or pelt bag made from a moisture and fat absorbing material, such as paper, which is situated between the pelt board and the pelt. The pelt bag will absorb moisture from the skin side of the pelt and the air flow will take up that moisture and transport it from the pelt bag and thus enhance the drying process. Air flowing from the outlets 35 at the edges of the pelt board will likewise flow longitudinally in longitudinal spaces 38 formed by the pelt bag and the expansion strips 3, 6 as shown in FIGS. 3*a* and 3*b*.

The side edges 19, 19' of the activation rod 9 are in engagement with the corresponding side edges 20, 20' of the two expansion strips 3, 6 and are formed with a plurality of protrusions 21, 21' that each has a wedge-shaped or slanted edge section 22, 22' and a longitudinal straight edge section 23, 23' at the outer tip of the protrusion 21, 21' and the protrusions 21, 21' are mutually separated by longitudinal straight edge sections 24, 24'.

The side edges 20, 20' of the two expansion strips 3, 6 are formed correspondingly, so that the side edges 20, 20' of the expansion strips 3, 6 and the side edges 19, 19' of the activation rod 9 are in contact along substantially the whole of the extent of the side edges 19, 19' 20, 20' when the expansion strips 3, 6 are in the non-expanded position as shown in FIG. 7.

The activation rod 9 is activated prior to the arrangement of a tubular pelt to be dried thereon by pushing the projecting element 18, which is an integrated part of the activation rod 9 upwards toward the inner part of the pelt board. Thereby, the activation rod 9 is displaced in the longitudinal direction of the pelt board, and the wedge-shaped edge sections 22, 22' will slide on the corresponding slanted edge sections 25, 25' of the expansion strips 3, 6 and thereby force the expansion strips 3, 6 away from the centre line of the pelt board from an non-expanded position to an expanded position. At the end of the expansion process, the longitudinal straight edge sections 23, 23' of the protrusions 21, 21' engages the longitudinal straight edge sections 26, 26' of the expansion strips 3, 6 whereby the expansion strips 3, 6 and the activation rod 9 are locked in the expanded position of the expansion strips 3, 6.

The freshly skinned tubular pelt from e.g. a mink has been scraped on the skin side to remove as much fat, meat, tendons etc. as necessary to obtain a satisfactory result, after which the pelt is drawn onto the pelt board from the tip end 13 with the fur side outwards, where the expansion strips 3, 6 are locked in the expanded position by beans of the activation rod 9. A pelt bag, which is well-known in the art, of a paper type for absorption of humidity and residual fat may be placed between the pelt board and the pelt, the pelt is stretched to a suitable length and is fastened to the pelt board by e.g. wrapping an elastic tape around the lower part of the pelt or by drawing a somewhat elastic, open-ended bag onto the pelt board on the outside of the pelt. The pelt is then allowed to dry, possibly with the aid of supplying a flow of drying air to the board as described previously. The tubular pelt shrinks during the drying process and will exert a squeezing force on the pelt board. The locking effect of the activation rod 9 will prevent the expansion strips 3, 6 from being pushed back into the pelt board. When the tubular pelt is dried and is to be removed from the pelt board, the projecting element 18 is pulled longitudinally in a direction away from the inner of the pelt board, which unlock the expansion strips 3, 6 and allow them to be forced towards the longitudinal centre line of the pelt board by the force of the dried pelt. The cross-sectional circumference C of the pelt board is thereby reduced, the pelt is loosened from the outer surface of the pelt board and the pelt may now easily be removed from the pelt board.

The pelt board is assembled from two identical half parts 1, 2, two identical expansion strips 3, 6 and one activation rod 9. The half parts 1, 2 comprise each a number of holes 27, 28 to receive studs (not shown) in snap connections. The studs and holes 27, 28 are designed so that a distance between the half parts 1, 2 is maintained when they are assembled and the expansion strips 3, 6 and the activation rod 9 have longitudinal through holes 29 through which the studs 26 pass, thereby retaining the expansion strips 3, 6 and the activation rod 9 while allowing them to move according to their function as described above.

In an alternative embodiment, the pelt board of FIGS. 1 to 8 comprises only one expansion strip 3, preferably with a larger movement to and from the longitudinal centre line of the pelt board than each of the individual expansion strips 3, 6 shown in the figures, so as to provide for a sufficient reduction of the cross-sectional circumference of the pelt board when the expansion strip 3 is moved to the non-expanded position.

Figure 9:
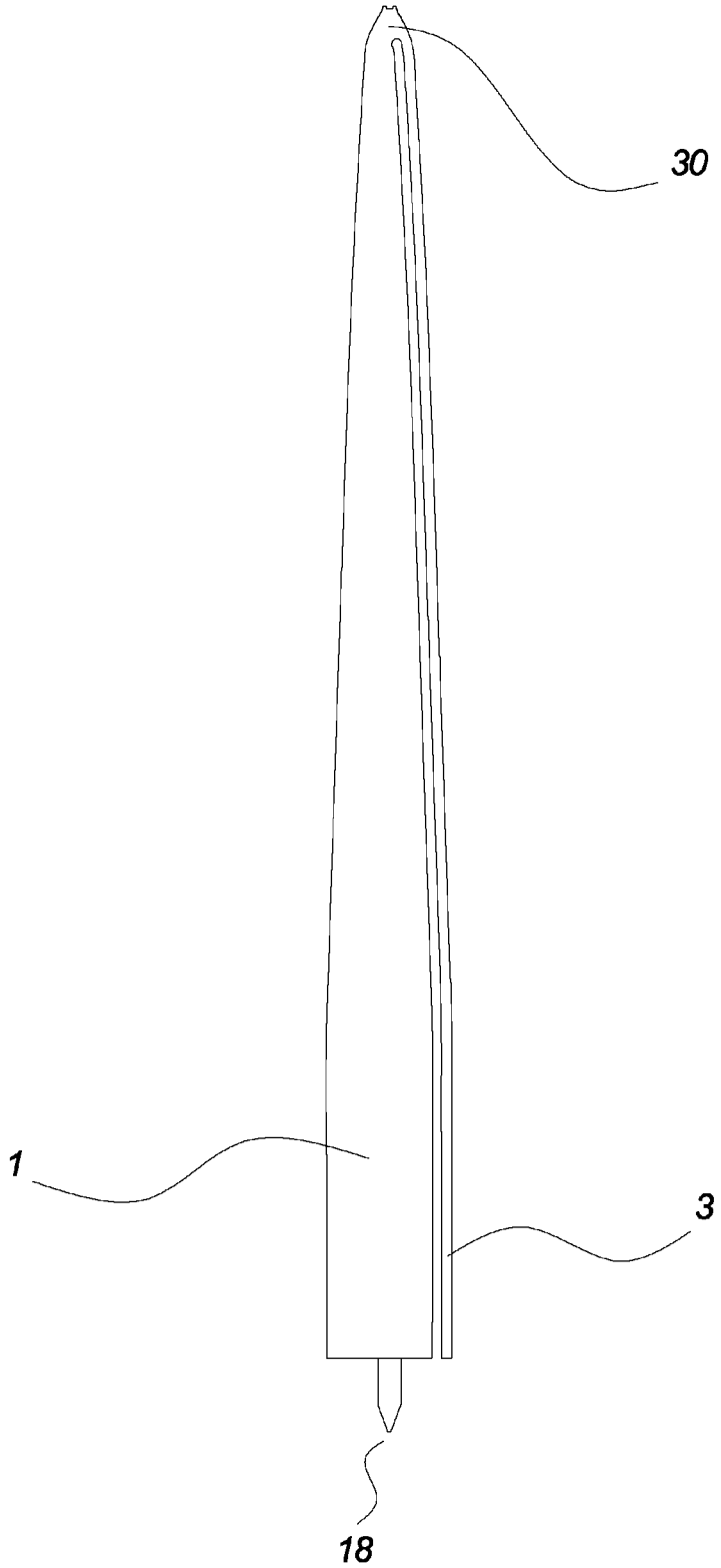
FIG. 9 is a side view of a second embodiment of the present invention

A second alternative embodiment is shown in FIG. 9, where the single expansion strip 3 is an integrated part of the half parts 1, 2 of the pelt board where the connection 30 between the half parts 1, 2 and the expansion strip 3 is sufficiently thin for providing the required freedom for the strip 3 to move to and from the longitudinal centre line of the pelt board. In an alternative embodiment, the pelt board of FIG. 9 is equipped with and expansion strip 3 of the type shown in FIG. 9 on both sides of the pelt board. In an alternative design of the second embodiment, the connection 30 could be replaced by a hinge. The activation of the expansion strip 3 may be made with a similar solution as shown with respect to the first embodiment.

Figure 10:
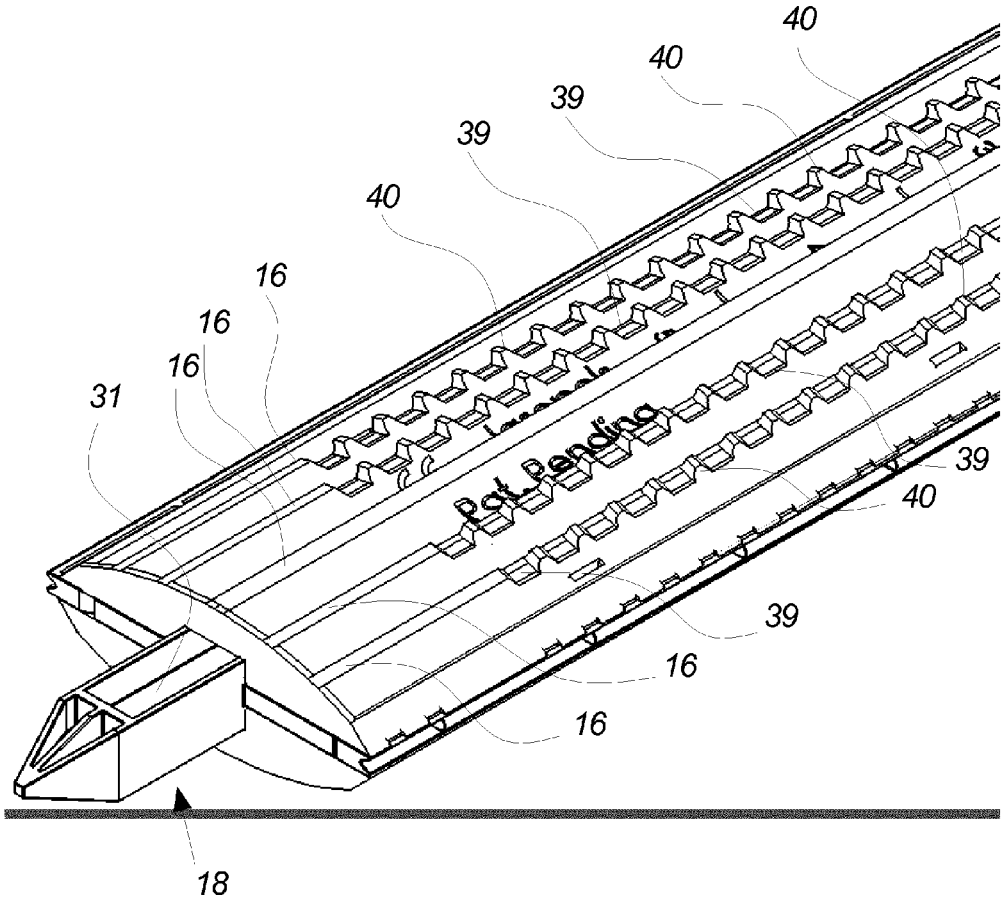
FIG. 10 is a perspective view of the lower part of a pelt board according to a third embodiment.
Figure 11:
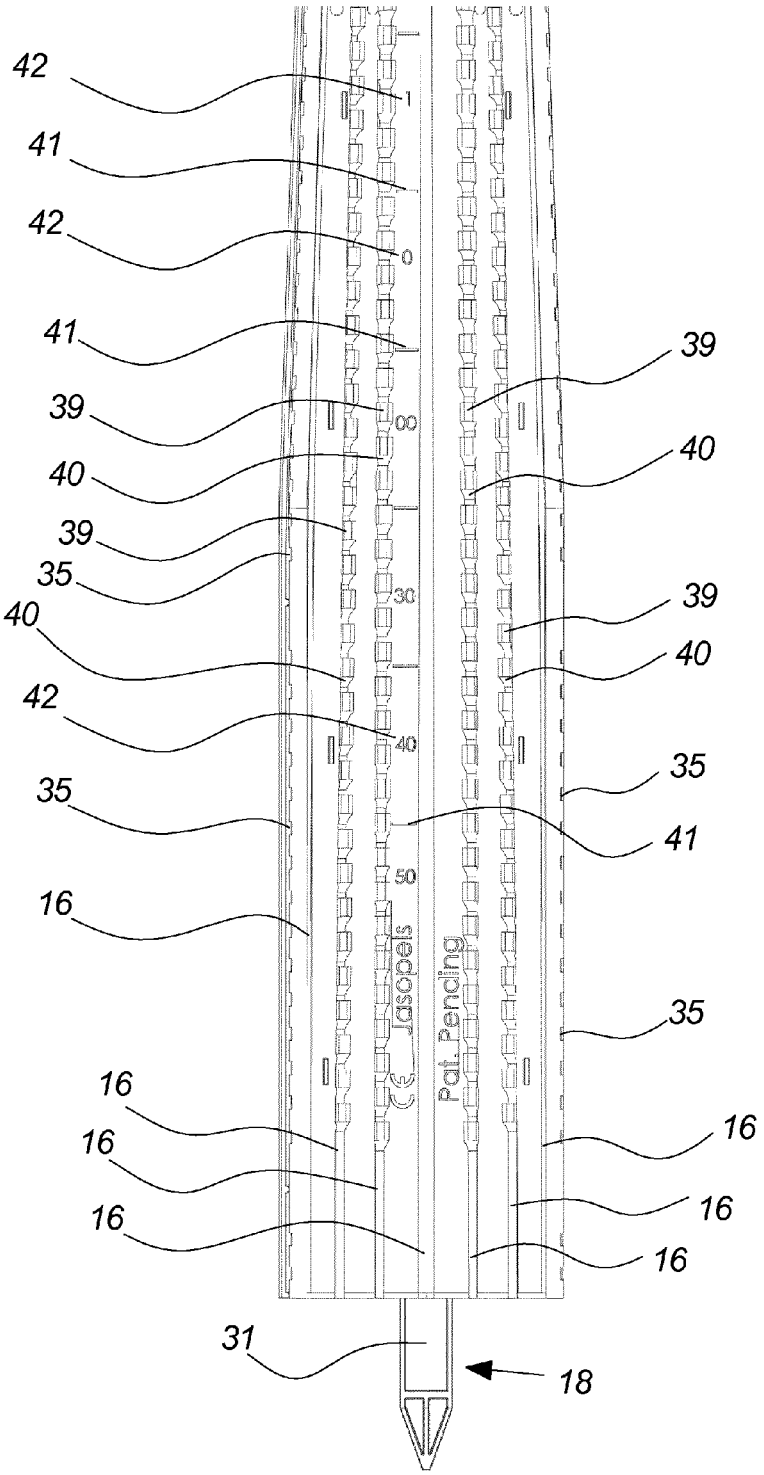
FIG. 11 is a front view of the lower part of the pelt board of FIG. 10.

A third embodiment is shown in FIGS. 10 11, which resembles the first embodiment shown in FIGS. 1 to 8 and has most features in common with that embodiment. However, the top of the longitudinal ridges 16 is made flat and the two ridges 16 on each side of the centrally extending ridge 16 are each provided with a series of indentations 39 leaving teeth 40 in between the indentations 39. The teeth 40 and indentations 39 provide for a better grip of the inner side of the tubular pelt on the surface of the pelt board when the pelt has been stretched and is fastened to the pelt board by wrapping an elastic tape around the lower part of the pelt or by drawing a somewhat elastic, open-ended bag onto the pelt board on the outside of the pelt.

The indentations 39 and teeth 40 are arranged staggering in neighbouring ridges 16, which is evident from FIGS. 10 and 11, so that an indentation 39 in one of the ridges 16 is neighbour to a tooth 40 in the other of the ridges 16 at the same longitudinal position of the pelt board.

The pelt board according to the third embodiment is furthermore provided with marks 41 that provides for an immediate visual detection of the length of the pelt stretched on and fastened to the pelt board as well as length indications 42 that indicates to the person or machine handling the pelt board which length of the pelt the mark 41 above the indication 42 specifies.

LIST OF REFERENCE NUMERALS

1 Front half part of pelt board
2 Back half part of pelt board
3 Expansion strip
4 Left edge of front half part
5 Left edge of back half part
6 Expansion strip
7 Right edge of front half part
8 Right edge of back half part
9 Activation rod
10 Straight section of pelt board
11 Foot end of pelt board
12 Conical section of pelt board
13 Tip end of pelt board
14 Outer broad elongated side surface of front half part
15 Outer broad elongated side surface of back half part
16 Longitudinally extending ridges
17 Openings for providing a flow of air
18 Projecting element
19, 19' The side edges of the activation rod
20, 20' The side edges of the two expansion strips
21, 21' Protrusions on the activation rod
22, 22' Wedge-shaped edge sections of protrusions
23, 23' Longitudinal straight edge sections of the protrusions
24, 24' Longitudinal straight edge sections between protrusions
25, 25' Slanted edge sections of the expansion strips
26, 26' Longitudinal straight edge sections of the expansion strips
27 Holes
28 Holes
29 Longitudinal through-holes
30 Connecting part
31 Open channels in activation rod
32 Mid-point for air distribution
33 Upper set of longitudinal channels
34 Transversal channels
35 Outlets at the outer end of the transversal channels
36 Lower set of longitudinal channels
37 Longitudinal spaces at the surface of the two half parts
38 Longitudinal spaces at the edges of the pelt board
39 Indentations in ridges
40 Teeth between indentations in ridges
41 Marks for length of pelt
42 Length indications
W Width of pelt board
H Height of pelt board
C Cross-sectional circumference

The invention claimed is:

1. A pelt board for stretching and drying of tubular pelts, the pelt board having a tip end from which the pelt is drawn onto the pelt board and a foot end, the pelt board comprising:

two half parts, each half part defining a broad elongated side surface, an expansion member defining a narrow elongated side surface extending between longitudinal edges of the two half parts, and an activation member for selectively moving the expansion member with respect to the two stationary half parts, to an expanded position and locking the expansion member in the expanded position, or unlocking the expansion member so that the expansion member is movable to a non-expanded position in which an outer cross-sectional circumference of the pelt board is reduced as compared to the expanded position.

2. The pelt board according to claim 1, wherein the expansion member defines narrow elongated side surfaces between longitudinal edges on both sides of the two half parts.

3. The pelt board according to claim 1, wherein the outer cross-sectional circumference of the pelt board is reduced by at least 3 millimeter when the expansion member is in its non-expanded position.

4. The pelt board according to claim 3, wherein the outer cross-sectional circumference of the pelt board is reduced in a range of 3 to 20 millimeters when the expansion member is in the non-expanded position of the expansion member.

5. The pelt board according to claim 1, wherein each broad elongated side surfaces comprises a conical shape.

6. The pelt board according to claim 1, wherein the activation member comprises an element projecting from one of the ends of the pelt board, wherein the activation member may be operated by means of the projecting element.

7. The pelt board according to claim 6, wherein the projecting element projects from the foot end of the pelt board.

8. The pelt board according to claim 6, comprising two projecting elements, one projecting from each end of the pelt board.

9. The pelt board according to claim 6, wherein the activation member may be operated by pulling or pushing the projecting element in a longitudinal direction of the pelt board.

10. The pelt board according to claim 1, having at least one inlet for receiving a flow of air and wherein each broad elongated side surfaces comprises openings connected to said inlet for providing a flow of air to a pelt arranged on the pelt board.

11. The pelt board according to claim 6, wherein at least one inlets for receiving a flow of air is situated in the projecting element.

12. The pelt board according to claim 1, wherein each broad elongated side surfaces comprises a plurality of longitudinally extending ridges.

13. The pelt board according to claim 12, wherein at least some of the ridges are provided with teeth or indentations at least at a lower part of the pelt board.

14. The pelt board according to claim 1, wherein said activation member comprises an elongated activation member extending in a longitudinal direction of the pelt board and being displaceably arranged in the longitudinal direction of the pelt board, a side edge of the activation member being in engagement with a corresponding side edge of the expansion member and comprising a series of wedge-shaped protrusions alternately with straight edge sections.

15. The pelt board according to claim 1, further comprising a plurality of marks distributed in a longitudinal direction of the pelt board to provide for visual detection of a length of the pelt stretched on and fastened to the pelt board.

16. The pelt board according to claim 3, wherein the outer cross-sectional circumference of the pelt board is reduced in a range of 5 to 15 millimeters.

17. The pelt board according to claim 10, wherein at least one of the inlets for receiving a flow of air is situated in a projecting element.

* * * * *